US009235168B2

(12) United States Patent
Kawai

(10) Patent No.: US 9,235,168 B2
(45) Date of Patent: Jan. 12, 2016

(54) IMAGE HEATING APPARATUS

(71) Applicant: CANON KABUSHIKI KAISHA, Tokyo (JP)

(72) Inventor: Hiroki Kawai, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/288,712

(22) Filed: May 28, 2014

(65) Prior Publication Data

US 2014/0356015 A1 Dec. 4, 2014

(30) Foreign Application Priority Data

May 30, 2013 (JP) ..... 2013-113650

(51) Int. Cl.
*G03G 15/20* (2006.01)

(52) U.S. Cl.
CPC ..... *G03G 15/2017* (2013.01); *G03G 15/2053* (2013.01); *G03G 2215/0132* (2013.01); *G03G 2215/2035* (2013.01)

(58) Field of Classification Search
CPC ..... G03G 15/2017; G03G 15/2053; G03G 2215/2035; G03G 2215/0132
See application file for complete search history.

(56) References Cited

U.S. PATENT DOCUMENTS

2011/0311261 A1* 12/2011 Yamashita et al. ..... 399/92
2012/0328323 A1* 12/2012 Murooka ..... 399/92
2013/0051831 A1 2/2013 Shinagawa et al.
2013/0058672 A1 3/2013 Takada et al.
2013/0129364 A1 5/2013 Kitagawa et al.
2013/0142532 A1 6/2013 Kitagawa et al.
2013/0164015 A1 6/2013 Kawai et al.
2013/0206745 A1 8/2013 Tanaka et al.

FOREIGN PATENT DOCUMENTS

JP 02205882 A * 8/1990
JP 10-26898 A 1/1998
JP 2000-338801 A 12/2000
JP 2005-56596 A 3/2005
JP 2011-33653 A 2/2011
JP 2011-141447 A 7/2011
JP 2013-073171 A 4/2013

OTHER PUBLICATIONS

Japanese Office Action dated Oct. 27, 2015 in counterpart Japanese Application No. 2014-080008.

* cited by examiner

*Primary Examiner* — Ryan Walsh
(74) *Attorney, Agent, or Firm* — Fitzpatrick, Cella, Harper & Scinto

(57) ABSTRACT

An image heating apparatus includes an endless belt for heating a toner image on a sheet in a nip. An inner surface of the belt is coated with a lubricant. The apparatus also includes a lubricant; a driving roller cooperative with the belt to form the nip, an urging member provided inside the belt to urge the belt toward the roller, a first regulating portion for regulating the position of the belt and configured to be abutted by one end edge of the belt, a first heat sink provided on the first regulating portion to cool the first regulating portion, a second regulating portion for regulating the position of the belt and configured to be abutted by the other end edge of the belt, and a second heat sink provided on the second regulating portion to cool the second regulating portion.

12 Claims, 11 Drawing Sheets

A - A

A - A

IMAGE HEATING APPARATUS

FIELD OF THE INVENTION AND RELATED ART

The present invention relates to an image heating apparatus for heating the toner image on a sheet of a recording medium.

In the field of an electrophotographic image forming apparatus, it has been a common practice to apply heat and pressure to a sheet of a recording medium and the toner image formed thereon, with the use of a fixing device (image heating device), to fix the toner image to the sheet of the recording medium. In the case of the fixing device disclosed in Japanese Laid-open Patent Applications 2005-56596 and 2011-33653, it employs a fixation belt (endless belt), the inward surface of which is coated with grease (lubricant).

Grease, such as the abovementioned one, contains components which evaporate (gasify) as they are heated during fixation. Therefore, it is possible that as these components evaporate (gasify), they will escape from the internal space of the fixation belt.

Thus, in the case of the apparatus disclosed in Japanese Laid-open Patent Application 2011-141447, the body of air which contains the gasified components are introduced into the air exhausting passage to cool the body of air with the use of the cooling surface(s) which is in the air exhausting passage to recover the gasified volatile components.

However, in a case where a fixing device is structured, like the apparatus disclosed in Japanese Laid-open 2011-141447, to recover the gasified volatile components after the gasified volatile components leak from the internal space of the fixation belt of the fixing device, there are the following issues.

That is, it is possible that while a part of the body of gasified volatile components from the abovementioned grease will leak out of the space, on the inward side of the fixation belt, and will disperse within the image forming apparatus while it travels to the portion of the apparatus, which is for recovering the gasified volatile components. Further, the gasified volatile components will be diluted by the ambient air. Therefore, it is possible that the image heating apparatus will not be as good as it could be, in the efficiency with which it recovers the gasified volatile components from the lubricant (capture efficiency).

SUMMARY OF THE INVENTION

According to an aspect of the present invention, there is provided an image heating apparatus comprising: an endless belt configured to heat a toner image on a sheet in a nip, wherein an inner surface of the endless belt is coated with a lubricant; a driving rotatable member cooperative with the endless belt to form the nip and configured to feed the endless belt; an urging member provided inside the endless belt and configured to urge the endless belt toward the driving rotatable member; a first regulating portion configured and positioned to regulate a position with respect to a longitudinal direction of the endless belt, the first regulating portion being capable of being abutted by one longitudinal end edge of the endless belt; a first heat sink provided on the first regulating portion configured to cool the first regulating portion; a second regulating portion configured and positioned to regulate the position with respect to a longitudinal direction of the endless belt, the second regulating portion being capable of being abutted by the other longitudinal end edge of the endless belt; and a second heat sink provided on the second regulating portion and configured to cool the second regulating portion.

According to another aspect of the present invention, there is provided an image heating apparatus comprising: an endless belt configured to heat a toner image on a sheet in a nip, wherein an inner surface of the endless belt is coated with a lubricant; a driving rotatable member cooperative with the endless belt to form the nip and configured to feed the endless belt; an urging member provided inside the endless belt and configured to urge the endless belt toward the driving rotatable member; a first hollow regulating portion configured and positioned to regulate the position with respect to a longitudinal direction of the endless belt, the first regulating portion being capable of being abutted by one longitudinal end edge of the endless belt; a first heat sink extending from an inside space of the endless belt to an outside through a hollow portion of the first flange configured and positioned to cool the first flange; a second hollow regulating portion configured and positioned to regulate the position with respect to a longitudinal direction of the endless belt, the first regulating portion being capable of being abutted by the other longitudinal end edge of the endless belt; and a second heat sink extending from the inside space of the endless belt to an outside through a hollow portion of the second flange configured and positioned to cool the second flange.

Further features of the present invention will become apparent from the following description of exemplary embodiments with reference to the attached drawings.

DESCRIPTION OF THE PREFERRED EMBODIMENTS

Hereinafter, some of the preferred embodiments of the present invention will be described in detail, with reference to the appended drawings.

(Image Forming Apparatus)

Figure 1:
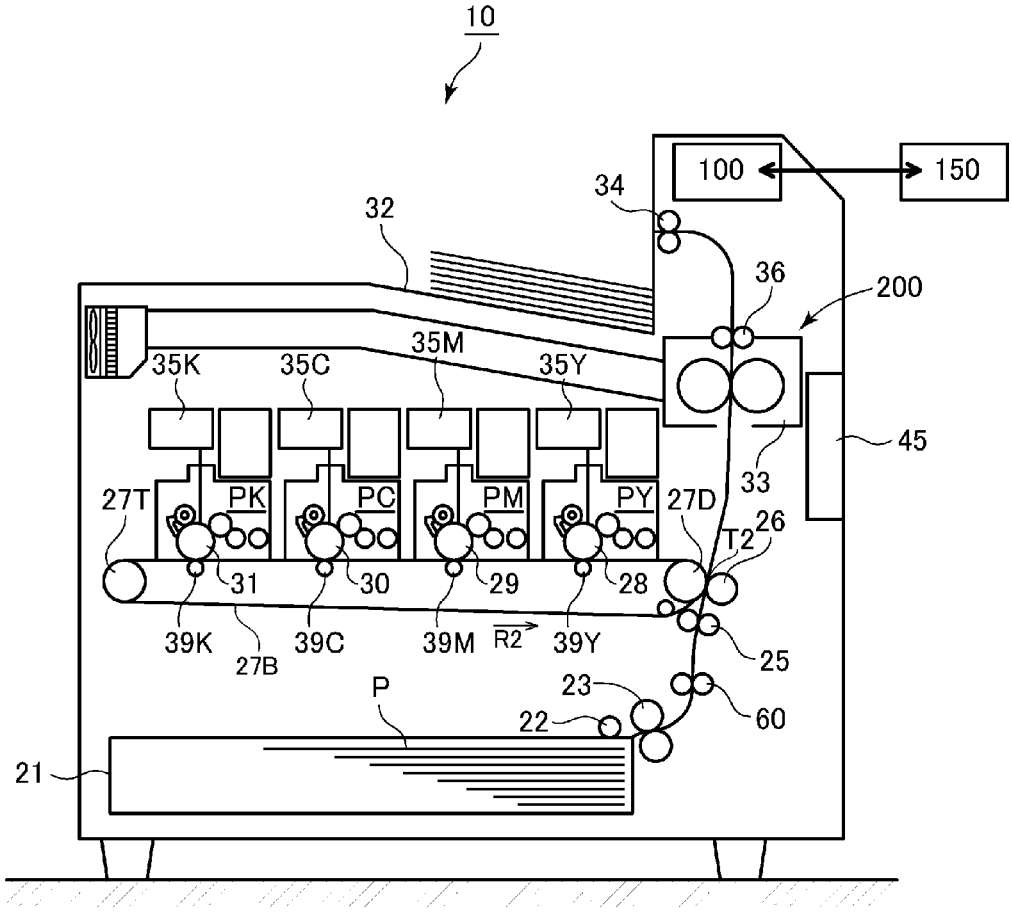
FIG. 1 is a drawing for illustrating the structure of a typical image forming apparatus to which the present invention is applicable.

FIG. 1 is a schematic sectional view of a typical image forming apparatus to which the present invention is applicable. It is for illustrating the structure of the apparatus. Referring to FIG. 1, an image forming apparatus 10 is a full-color printer of the so-called tandem type, and also, of the so-called intermediary transfer type. It has image forming portions PY, PM, PC and PK for forming yellow, magenta, cyan and black toner images, respectively. The image forming portions are aligned in parallel (tandem) in the listed order, along the intermediary transfer belt 27B.

In the image forming portion PY, a yellow toner image is formed on the photosensitive drum 28, and is transferred onto the intermediary transfer belt 27B. In the image forming portion PM, a magenta toner image is formed on the photosensitive drum 29, and is transferred onto the intermediary transfer belt 27B. In the image forming portions PC and PK, cyan and black toner images are formed on photosensitive drums 30 and 31, respectively, and are transferred onto the intermediary transfer belt 27B.

After the transfer of the four toner images, different in color, onto the intermediary transfer belt 27B, the four toner images are conveyed to the secondary transfer portion T2, in which they are transferred onto a sheet P of a recording medium (secondary transfer). Meanwhile, the sheets P of the recording medium in the sheet cassette 21 are pulled out of the cassette 21 by the pickup roller 22. As the sheets P are pulled out of the cassette 21, they are separated one by one by the pair of separation rollers 23, and they are sent one by one to the pair of registration rollers 25, which send each sheet P to the secondary transfer portion T2 with such a timing that the sheet P arrives at the secondary transfer portion T2 at the same time as the toner images on the secondary transfer belt 27B.

The fixing device 200 is removably held in the main assembly of the image forming apparatus 10. More specifically, the main assembly is provided with the door 45, and the fixation device 200 can be installed into, or removed from, the main assembly by opening the door 45. After the transfer (secondary transfer) of a toner image onto the sheet P of the recording medium, the sheet P and the toner image thereon are subjected to heat and pressure by the fixing device 200, whereby the toner image becomes fixed to the surface of the sheet P. Then, the sheet P is discharged from the main assembly of the image forming apparatus 10 by the pair of discharge rollers 34 to be accumulated in the delivery tray 32 of the apparatus 10.

The image forming portions PY, PM, PC and PK are roughly the same in structure, although they are different in the color of the toner they use. Hereafter, therefore, only the image forming apparatus PY will be described in order not to repeat the same description, because the description of the image forming portions PM, PC, and PK are virtually the same as that of the image forming portion PY.

The image forming portion PY is provided with a charging device, an exposing device 35Y, a developing device, a transfer roller 39Y, and a drum cleaning device, which are disposed in the listed order in the adjacencies of the peripheral surface of the photosensitive drum 28. The photosensitive drum 28 is made up of an aluminum cylinder, and a photosensitive layer formed on the peripheral surface of the aluminum cylinder. It is rotated at a preset process speed.

The charging device uniformly charges the photosensitive drum 28 to the negative polarity, with the use of its charge roller. The exposing device 35Y emits a beam of laser light while deflecting the beam with its rotational mirror so that the beam will scan the peripheral surface of the photosensitive drum 28. Consequently, an electrostatic image is formed on the peripheral surface of the photosensitive drum 28. The developing device develops the electrostatic image on the photosensitive drum 28, with the use of developer which is made up of toner and carrier. As the developing device develops the electrostatic image, it is replenished with the toner from the toner bottle, by an amount proportional to the amount by which the toner in the developing device was consumed for the image formation operation.

The transfer roller 39Y forms the primary transfer portion between the photosensitive drum 28 and intermediary transfer belt 27B. As the positive direct current voltage is applied to the transfer roller 39Y, the negatively charged toner image on the peripheral surface of the photosensitive drum 28 is transferred onto the intermediary transfer belt 27B. The drum cleaning device recovers the transfer residual toner, which is the toner remaining adhered to the peripheral surface of the photosensitive drum 28 after the toner image transfer onto the sheet P.

The intermediary transfer belt 27B is suspended by a combination of a tension roller 27T, a driver roller 27D, and an idler roller. It is driven by the driver roller 27D so that it rotates in the direction indicated by an arrow mark R2. The driver roller 27D doubles as the inward secondary transfer roller. The secondary transfer roller 26 forms the secondary transfer portion T2 by being placed in contact with the intermediary transfer belt 27B which is backed up by the driver roller 27D. As the positive direct current is applied to the secondary transfer roller 26, the toner image on the intermediary transfer belt 27B is transferred onto the sheet P of the recording medium. The belt cleaning device, which is unshown, recovers the transfer residual toner, which is the toner remaining adhered to the surface of the intermediary transfer belt 27B after the toner image is transferred onto the sheet P.

Figure 2:
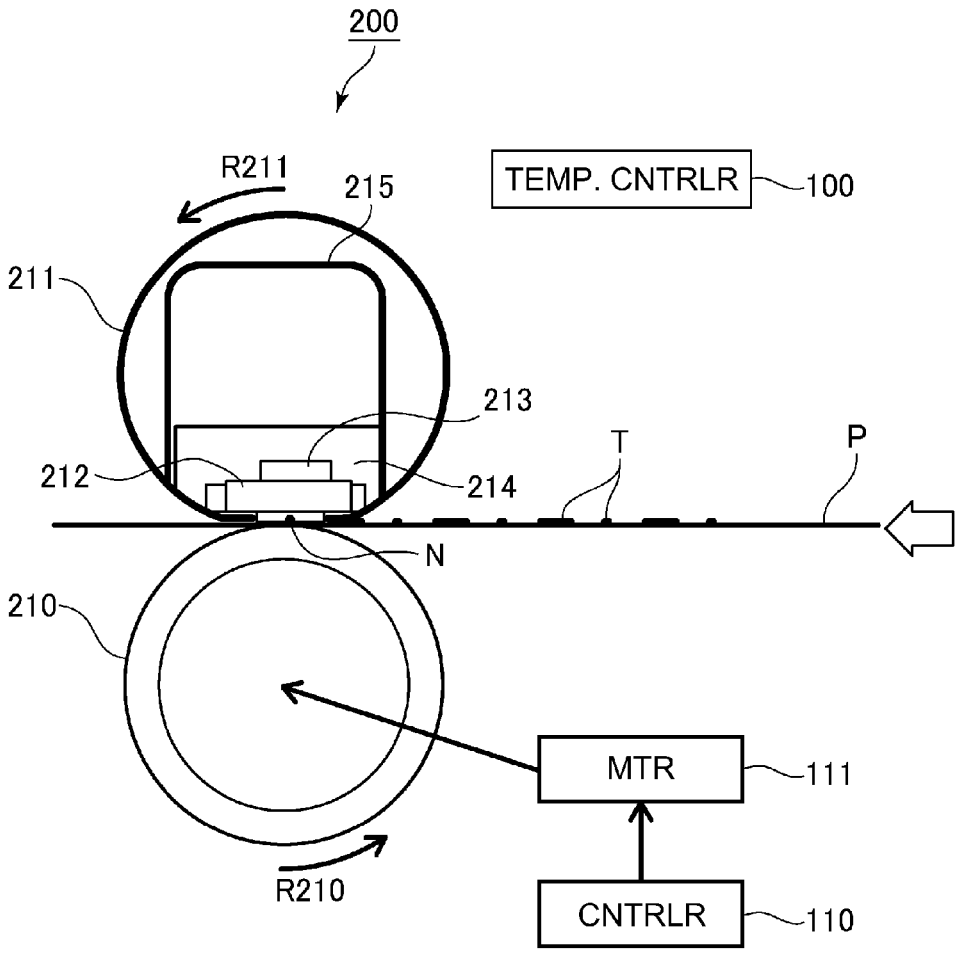
FIG. 2 is a schematic sectional view of a typical fixing device (apparatus) which is compatible with the present invention, at a plane which is perpendicular to the rotational axis of the pressure roller (fixation belt) of the fixing device. It is for illustrating the structure of the device.

Referring to FIG. 2, the fixation belt 211 is an example of an endless belt. Its inward surface is coated with lubricant, more specifically, grease, which contains volatile components. It heats the toner image on the sheet P of the recording medium while being circularly driven by the pressure roller 210, which will be described later. The pressure roller 210 is an example of a rotationally drivable member. It forms a nip by being placed in contact with the fixation belt 211. The flange 216 is an example of a regulating member. It regulates the lateral movement of the fixation belt 211 by being in contact with the corresponding edge of the fixation belt 211. That is, the flange 216 has the function of a stopper which regulates the fixation belt 211 in terms of lateral movement.

The heater 212 is an example of heating means (pressing member). It heats the fixation belt 211. The belt guide 214 (which includes heater 212) is an example of a member upon which the fixation belt 211 slides. It contacts the inward surface of the fixation belt 211 in such a manner that the fixation belt 211 is allowed to slide on the belt guide 214. The supporting stay 215 is an example of a backup member. It is not rotational, and is positioned so that it extends from one of the lengthwise ends of the flanges 216 to the other through the inward space of the fixation belt 211, in parallel to the rotational axis of the fixation belt 211. It backs up the belt guide 214.

(Fixing Device)

Figure 3:
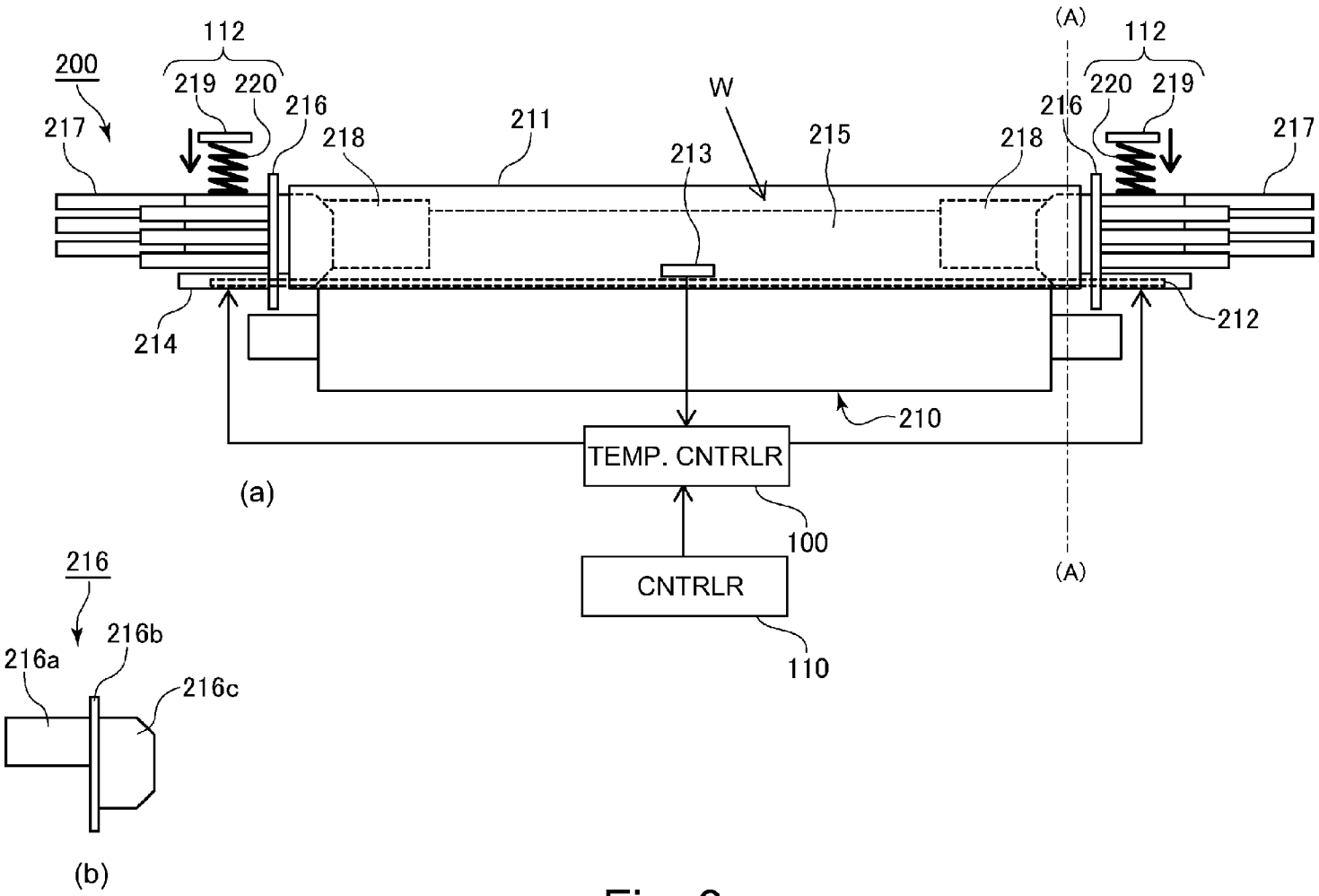
FIG. 3 is a schematic sectional view of a typical fixing device (apparatus) which is compatible with the present invention, at a plane which is parallel to the rotational axis of the pressure roller (fixation belt) of the fixing device. It is for illustrating the structure of the device.

FIG. 2 is a schematic sectional view of the fixing device 200 in this embodiment, at a plane perpendicular to the lengthwise direction of the fixing device 200. It is for illustrating the structure of the fixing device 200. FIG. 3 is a schematic sectional view of the fixing device 200, at a plane parallel to the lengthwise direction of the fixing device 200. It is for illustrating the structure of the fixing device 200.

Referring to FIG. 2, the fixing device 200 is an image heating device of the so-called belt-heating type.

The fixation belt 211 is an example of an endless belt. Its inward surface is coated with lubricant, which contains volatile components. It is rotationally driven.

The belt guide 214, which is an example of a slippery belt guiding member, is positioned on the inward side of the belt loop, in contact with the inward surface of the fixation belt 211 so that it supports the fixation belt 211 while allowing the fixation belt 211 to slide on the belt guide 214. The belt guide 214 is formed of a resinous substance such as PPS (polyphenylene sulfide), PAI (polyamide-imide), PI (polyamide), PEEK (polyether-ether-ketone), which is heat resistant and dielectric, and can withstand a large amount of weight.

The heater 212, which is an example of heating means, is a ceramic heater for heating the fixation belt 211 as the fixation belt 211 slides on the heater 212. The heater 212 is fixed to the belt guide 214; the heater 212 is fitted in the shallow groove which is in the roughly center portion of the bottom surface of the belt guide 214. The heater 212 is provided with a heat generating member (electrically resistant member) which generates heat as electric current flows through it. It heats the fixation belt 211 from the inward side of the belt loop.

The pressure roller 210 is a heat-resistant elastic roller, which is made up of a metallic center shaft, and an elastic layer formed of heat-resistant rubber, around the center shaft. The pressure roller 210 is rotatably supported by a pair of bearings, by its lengthwise ends. It rotates in the direction indicated by an arrow mark R210, by being rotationally driven by the motor 111. As the pressure roller 210 rotates, the fixation belt 211 is driven by the friction between the pressure roller 210 and fixation belt 211, around the combination of the belt guide 214 and the heater 212, in the direction indicated by an arrow mark R211.

Next, referring to FIG. 3, the flange 216, which is an example of a regulating member, regulates the movement of the fixation belt 211 in the direction parallel to the rotational axis of the fixation belt 211, by coming into contact with the corresponding edge of the fixation belt 211. The flange 216 has a belt catching (contacting) portion 216*b*, which regulates the lateral movement of the fixation belt 211, and a belt supporting slippery surface 216*c*, which is an extension of the belt catching portion 216*b*, and supports the fixation belt 211 by being placed in contact with the inward surface of one of the edge portions of the fixation belt 211. The flange 216 is formed of a resinous substance such as PPS (polyphenylene sulfide), PAI (polyamideimide), PI (polyimide), PEEK (polyetheretherketone), which is heat resistant and dielectric, and can withstand a large amount of weight. The flange 216 is a stay holder, with which the left and right end portions of the supporting stay 215 are fitted. The flange 216 is supported by the metallic frame (unshown) of the fixing device 200, by being fitted into the metallic frame.

In order to support the belt guide 214, the supporting stay 215, which is an example of a beam-like member, is put through the combination of the fixation belt 211 and flange 216 in the direction parallel to the rotational axis of the fixation belt 211, and is fixed in a non-rotational manner. The supporting stay 215 is formed of a metallic substance such as stainless steel and iron, which is high in mechanical strength. It is U-shaped in its cross-section perpendicular to the rotational axis of the fixation belt 211. The supporting stay 215 is positioned in contact with the belt guides 214 in such a manner that it appears as if the guides 214 extends from the lengthwise ends of the supporting stay 215, one for one.

The compression springs 220 are positioned, in the compressed state, between the left and right spring seats 219 fixed to the casing of the fixing device 200, and the left and right flanges 216, respectively. The supporting stay 215 is fitted with the flanges 216. Thus, the lengthwise end of the supporting stay 215 are kept pressed toward the pressure roller 210 by the compression springs 220, with the presence of flange 216 between the compression springs 220 and supporting stay 215. As the pressure roller 210 is subjected to the pressure from the compression springs 220, the elastic layer 210 of the pressure roller 210 deforms, creating thereby the nip N, which has a preset width in terms of the recording-medium conveyance direction.

Next, referring to FIG. 2, as the fixation belt 211 is driven, it slides on the downwardly facing surface of the heater 212. As electric current is flowed through the heater 212, the heater 212 begins to generate heat to heat the fixation belt 211. Then, while the temperature of the fixation belt 211 is kept at a preset level (fixation temperature), the sheet P of the recording medium on which an unfixed toner image T is present is introduced into the nip N in such an attitude that the surface of the sheet P, on which the toner image is present, comes into contact with the fixation belt 211. Then, the sheet P is conveyed along with the fixation belt 211 through the nip N, remaining pinched between the fixation belt 211 and the pressure roller 210.

In the nip N, the heat generated by the heater 210 heats the surface of the sheet P through the fixation belt 211. Thus, while the sheet P is conveyed through the nip N, the unfixed toner image T on the sheet P is melted and crushed, being thereby fixed to the sheet P. After being conveyed through the nip N, the sheet P is separated from the surface of the fixation belt 211 by the curvature of the fixation belt 211.

(Fixation Belt)

The fixation belt 211 is a multilayered endless belt. It has a parting layer, an elastic layer, a substrative layer, and an inward layer.

The parting layer is a piece of PFA tube which is 30 μm in thickness. It is desired to be no more than 100 μm, preferably, 20-70 μm, in thickness. The material for the parting layer may be other fluorinated resin than PFA. For example, it may be PTFE, FEP, or the like.

The elastic layer is formed of silicon rubber which is 10 degrees in hardness (JIS-A), and 1.3 W/m·K in thermal conductivity. It is 300 μm in thickness. In order for the elastic layer to be small in thermal capacity to enable the fixing device 200 to quickly start up, the elastic layer is desired to be no more than 1000 μm, preferably, 500 μm, in thickness. As for the material for the elastic layer, heat-resistant rubber is usable. Further, fluorinated rubber or the like can also be used as the material for the elastic layer.

The substrative layer is a cylindrical nickel film formed by electrical casting. It is 30 μm in thickness, and 25 mm in diameter. In order for the substrative layer to be small in thermal capacity to enable the fixing device 200 to quickly start up, the substrative layer is desired to be no more than 100 μm, preferably, 50 μm, in thickness. From the standpoint of strength, however, it is desired to be no less than 20 μm in thickness. Instead of nickel, other metallic substances which are heat-resistant and high in thermal conductivity can be used as the material for the substrative layer. For example, stainless steel film may be used.

The inward surface layer is formed of polyamide, and is 10 μm in thickness. It slides on the ceramic heater when the ceramic heater is very high in temperature. Therefore, highly heat-resistant engineering plastic is used as the material for the inward surface layer. Instead of engineering plastic, polyamide-amide, PEEK, polytetrafluoroethylene (TTFE), copolymer of tetrafluoroethylene/hexafluoropropylene (FEP), copolymer of tetrafluoroethylene/perfluor-alkylvinylether (FFA), or the like may be used.

(Control of Heater Temperature)

Figure 4:
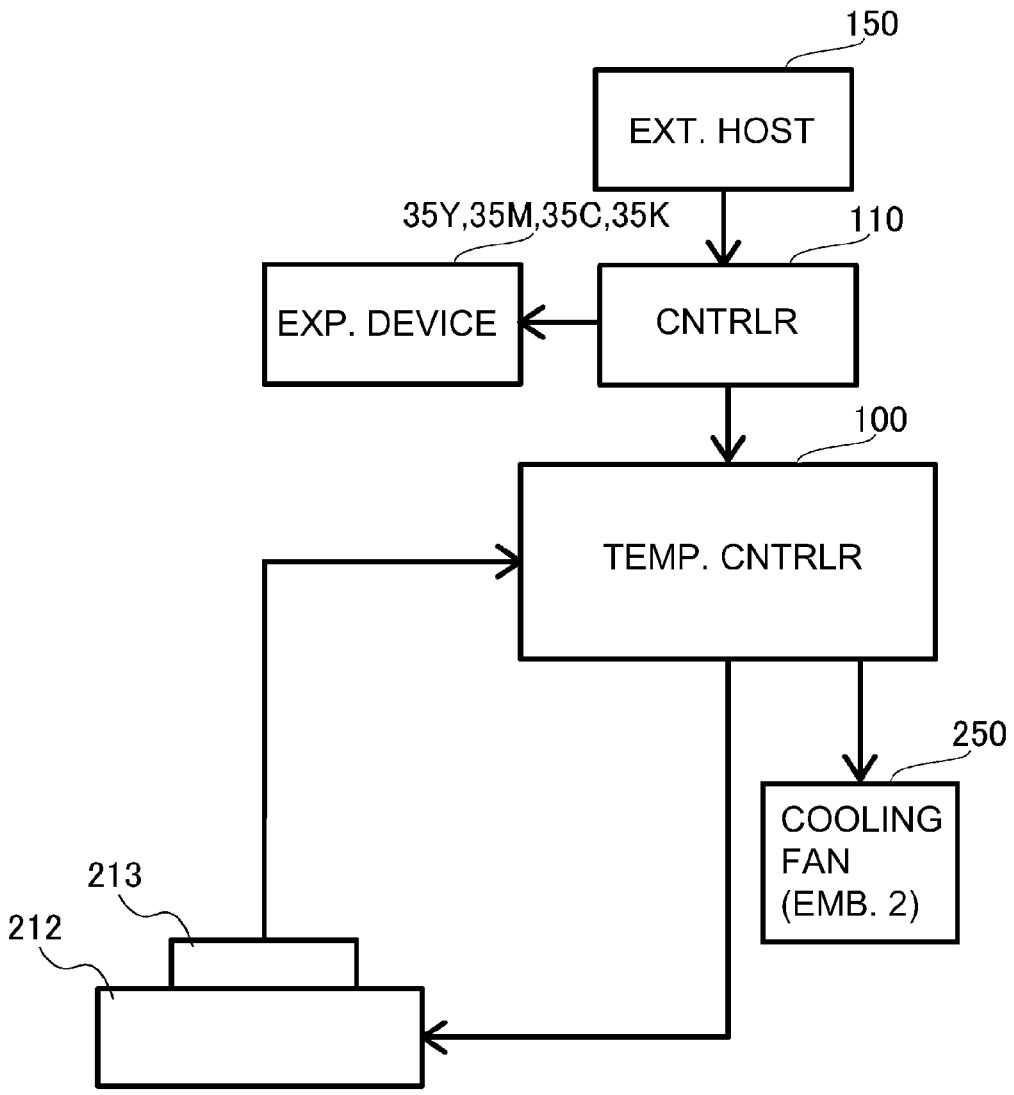
FIG. 4 is a block diagram of the control system of the image forming apparatus.
Figure 5:
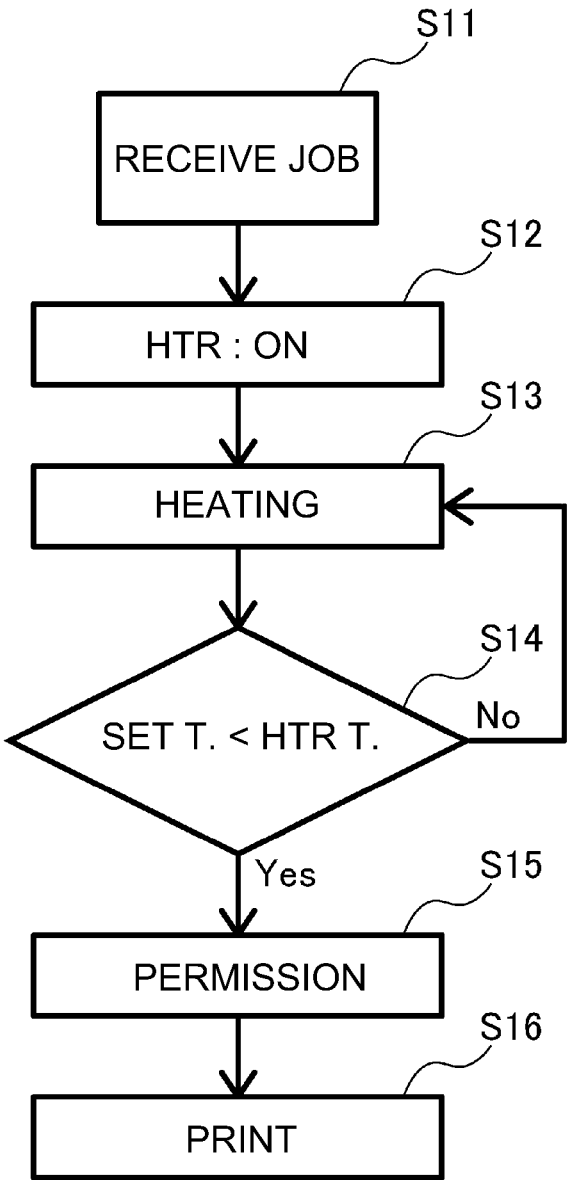
FIG. 5 is a flowchart of the temperature control sequence of the image forming apparatus.

FIG. 4 is a block diagram of the control system of the image forming apparatus 10. FIG. 5 is a flowchart of the control sequence for controlling the temperature of the fixing device 200.

Referring to FIG. 3, the heater 212 is made up of a long and narrow ceramic substrate, the long edges of which are perpendicular to the drawing, and a heat generating resistor formed by printing in a preset pattern on one of the primary surfaces of the ceramic substrate. The heater 212 is low in thermal capacity, and high in output. Therefore, as electric current flows through the heat generating resistor layer, the heater 212 very quickly increases in temperature. The thermistor 213 is fixed to roughly the center of the back surface of the heater 212. The temperature control circuit 100 increases or reduces the amount of electric power supplied to the heater 212 while measuring the temperature of the heater 212 with the use of the thermistor 213 as the heater 212 is cooled by the fixation belt 211.

Next, referring to FIG. 4, the temperature control circuit 100 controls the electric power supply to the heater 212 so that the temperature detected by the thermistor 213 remains at a preset level. Before the control portion 110 starts an image formation job inputted from the external host apparatus 150, it provides the temperature control circuit 100 with a target temperature level according to the type (specification) of the recording medium selected for the image formation job.

Next, referring to FIG. 5 along with FIG. 2, as the temperature control circuit 100 receives a command to carry out an image formation job, from a user (S11), it begins to supply the heater 212 with electric power (S12). The temperature control circuit 100 continues to supply the heater 212 with electric power until the temperature of the heater 212 reaches the preset level (No in S14, S13). As the temperature of the heater 212 reaches the preset level (Yes in S14), the temperature control circuit 100 issues a print permission command (S15). Then, the image forming apparatus 10 begins the printing operation (S16).

(Cooling System)

Figure 6:
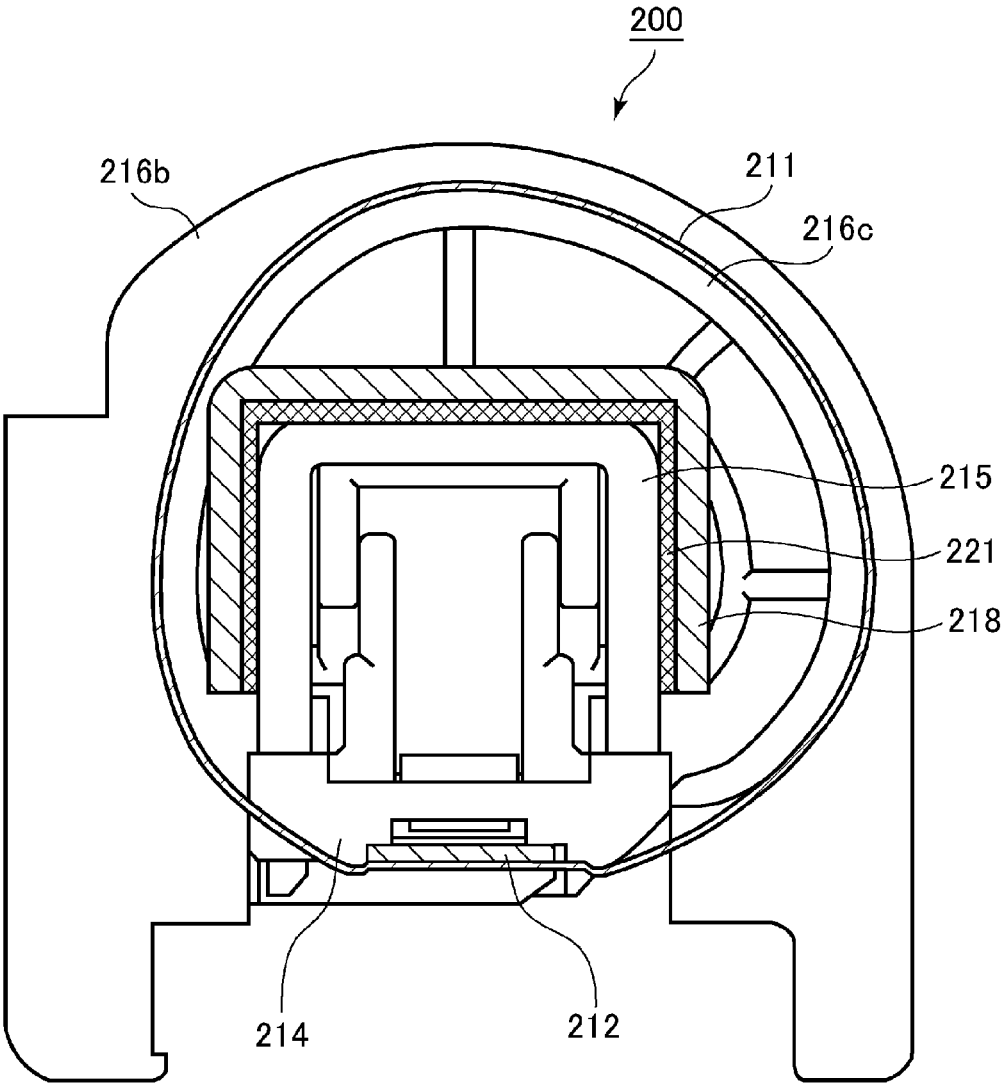
FIG. 6 is a schematic sectional view of one of the lengthwise end portions of the fixation film portion of the fixing device in the first embodiment of the present invention. It is for illustrating the structure of the lengthwise end portion of the fixation film portion of the fixing device.

FIG. 6 is a schematic sectional view of one of the lengthwise end portions of the fixing device 200 in the first embodiment, at a plane (A)-(A) in FIG. 3. It is for illustrating the cooling system of the device 200.

Referring to FIG. 6, the heat sink, which is an example of a cooling system, is provided with a cooling portion 218 and a heat radiating portion 217. The heat sink is positioned in the internal space W (FIG. 3(*a*)) of the fixation belt 211 so that it extends outward from the inward side of the fixation belt 211 in terms of the lengthwise direction of the fixation belt 211, through the hollow of the flange 216. This internal space W of the fixation belt 200 is the space (a rectangular parallelepipedic space in FIG. 3, which in reality is a cylindrical space) surrounded by the fixation belt 211.

The cooling portion 218 of the heat sink has a cooling surface which faces the inward surface of the edge portion of the fixation belt 211. The cooling portion 218 is fixed so that it covers the supporting stay 215 with the presence of the heat insulating member 221 between itself and supporting stay 215.

Next, referring to FIG. 3, the heat radiating portion 217 of the heat sink plays the role of keeping the temperature of the cooling portion 218 below the temperature level above which the volatile components of the lubricant vaporize (gasifies). It has heat-radiating surfaces (heat-radiation fins) which are in contact with the ambient air, on the outward side of the fixation belt 211. The heat radiating portion 217 and the cooling portion 218 are directly connected to each other, and are integral parts of the heat sink.

The heat radiating portions 217 and 218 are the same in material and are directly connected to each other. They are supported by the supporting stay 215 with the placement of the heat insulating member (which will be described later) between themselves and the supporting stay 215. They are positioned so that they extend, along with the supporting stay 215, through the flange 216.

The heat radiating portions 217 and 218 are formed by bending a piece of copper plate painted black. They may be formed of metallic substances other than copper. For example, they may be formed of a metallic substance such as aluminum alloy or the like, which is excellent in thermal conductivity.

The heat radiating portion 217 is cooled outside the fixation belt 211, and keeps the surface temperature of the cooling portion 218 and the flange 216 low. In order to ensure that heat is efficiently transferred from the flange 216 heated by the fixation belt 211, to the heat radiating portion 217 so that the surface temperature of the flange 216 is kept low, the heat radiating portions 217 and 218 are put through the through holes, with which the flange 216 is provided, with the presence of no gap between themselves and the flange 216. More specifically, the gaps between the flange 216 and heat radiating portions 217 and 218 are filled with heat-resistant grease, the main component of which is silicon oil, so that even microscopic gaps remain between the flange 216 and heat radiating portions 217 and 218. The thermal conductivity between the heat radiating portions 217 and 218 and the flange 216 can be further improved by using heat-resistant grease which contains metallic particle such as silver particles.

Referring to FIG. 6, the cooling portion 218 is positioned so that it remains in contact with the inward surface of the fixation belt 211 and the outward surface of the supporting stay 215.

The heat-insulating member 221 is positioned between the supporting stay 215 and the cooling portion 218 to prevent the heat conduction from the supporting stay 215 to the cooling portion 218. It is a piece of felt or the like formed of heat-insulating fiber, such as porous ceramic fiber. It is desired to be no more than 0.1 W/m·K in thermal conductivity at 80 degrees in temperature.

The cooling portion 218 is not directly in contact with members of the fixing device 200 other than the flange 216 and the heat-insulating member 221. That is, it is in contact with only the air in the internal space of the fixation belt 211 and the flange 216, playing thereby the role of the heat exchanger between the air in the internal space of the fixation belt 211 and the flange 216. More specifically, the cooling portion 218 cools the flange 216 by robbing heat from the flange 216 through the area of contact between itself and the flange 216. Further, the cooling portion 218 plays the role of condensing the vapor (gas) generated by the volatile components of the lubricant. That is, the cooling surface of the cooling portion 218, that is, the surface of the portion of the cooling portion 218, which is in the internal space of the fixation belt 211 and faces the inward surface of the fixation belt 211, condenses the vapor (gas) generated by the volatile components of the lubricant. As long as the temperature of the cooling surface is kept below the boiling temperature (roughly 80 degrees) of the volatile components of the lubricant, the cooling surface can condense the gasified volatile components from the lubricant, within the internal space of the fixation belt 211, and therefore, can reduce the fixing device 200 in the internal pressure of the internal space W of the fixation belt 211 of the fixing device 200. That is, the cooling surface liquefies the gasified volatile components from the volatile component of the oily lubricant, before the gasified volatile components come into contact with the flange 216. That is, the cooling surface captures as much as possible the gasified volatile components attributable to the lubricant on the inward surface of the fixation belt 211, which tends to leak out of the internal space of the fixation belt 211, at the lengthwise ends of the fixation belt 211.

The heat radiating portion 217 is for efficiently radiating the heat which transfers into the heat radiating portion 217 from the cooling portion 218 and the flange 216, into the internal space of the casing of the fixing device 200. Thus, it is made up of multiple fins which are in the form of a sword blade, which is unlikely to interfere with the natural convection of air (gaseous substances).

Each fin is in the form of a rectangular parallelepiped, which is 1 mm in cross-sectional area and 3 mm in height. The greater the surface area of each fin, the greater the heat radiation of each fin. Therefore, the longer the length of each fin, the higher the cooling performance of each fin. In this embodiment, therefore, the fins of the heat radiating portion 217 are made to be 30 mm in length, which is the largest value within a range in which the fins are not exposed from the casing of the fixing device 200.

The greater the number of the fins, the greater the heat radiation area of the heat radiating portion 217. However, as the heat radiating portion 217 becomes higher in fin density than a certain value, the natural convection of air (gasified volatile components) which occurs around the fins are interfered with by the fins themselves. Consequently, the ambient air of the fins increases in temperature, which in turns reduces the heat-radiation efficiency of the fins. Thus, the heat radiating portion 217 is structured so that a 3 mm of interval is provided between the adjacent two fins.

In the first embodiment, the fins are shaped and positioned as described above. However, the first embodiment is not intended to limit the present invention in terms of the structure of the heat radiating portion of a fixing device, and/or the shape of the heat radiating portion. That is, this embodiment may be optimized in heat radiation according to the size of the flange 216, how the flange 216 is attached, and the temperature range in which the fixing device 200 is used.

Evaluation of Embodiment 1

Figure 7:
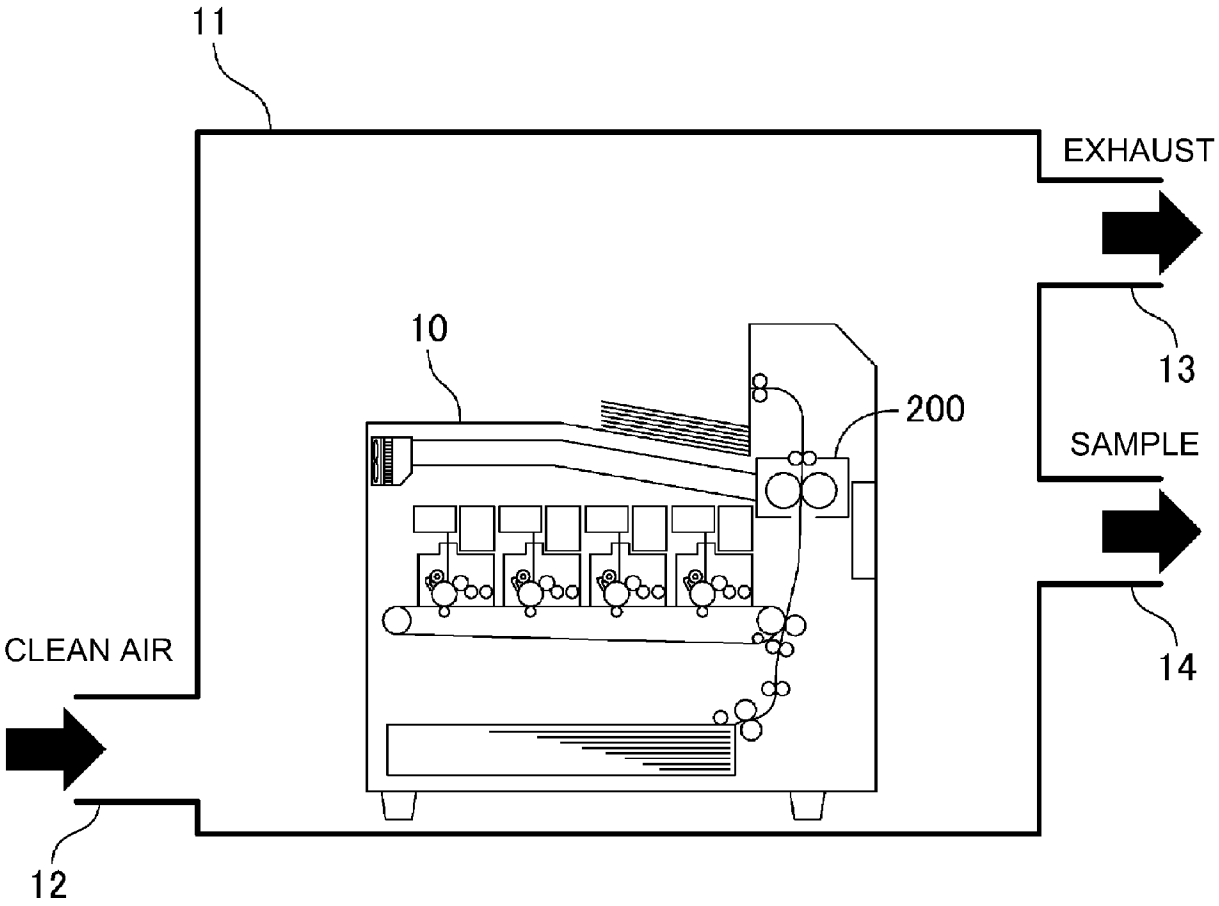
FIG. 7 is a schematic drawing for illustrating an apparatus for measuring the amount by which the volatile components of the grease applied to the fixation belt of the fixing device is discharged from the image forming apparatus.
Figure 8:
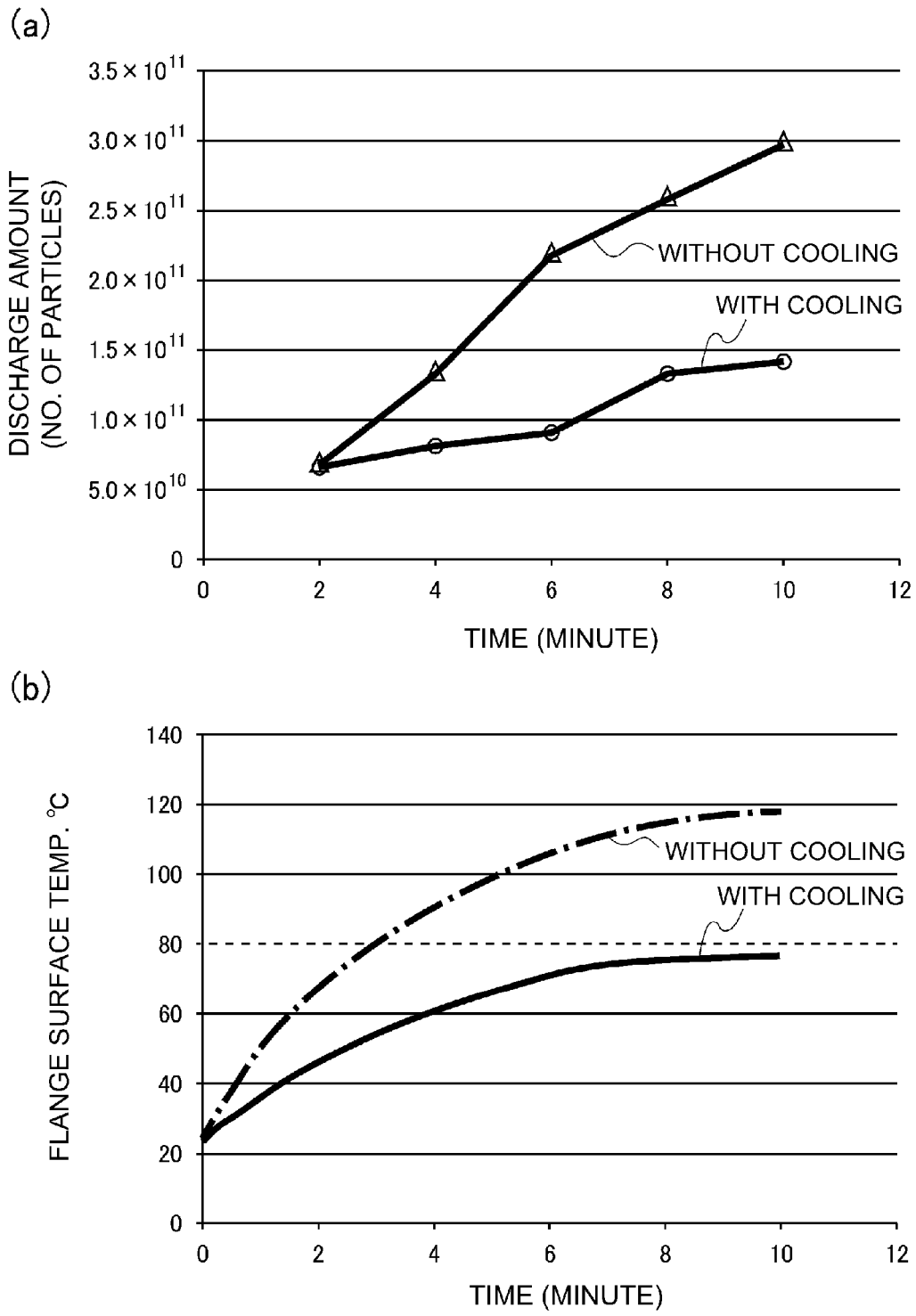
FIG. 8 is a graph for illustrating the effectiveness of the first embodiment in reducing the fixing device in the amount by which the volatile components in the grease applied to the fixation belt is discharged from the image forming apparatus.

FIG. 7 is a drawing for illustrating the apparatus for measuring the amount of volatile components emitted from an image forming apparatus. FIG. 8 is a drawing for illustrating the effects of the first embodiment upon the reduction in the amount of volatile component emission. FIG. 8(*a*) shows the chronological changes in the amount of volatile component emission, and FIG. 8(*b*) shows the chronological changes in the surface temperature of the flange 216.

Referring to FIG. 2, the fixing device 200 is controlled so that the temperature of its heater detected by the thermistor 213 remains at 200 degrees. That is, the target temperature level for the temperature control of the heater 212 is 200 degrees. When the temperature of the heater 212 detected by the thermistor 213 is 200 degrees, the surface temperature of the fixation belt 211 is roughly 150 degrees. This numerical value given as the target temperature level for the heater 212 is just an example. In other words, a value different from 200 degrees may be used. The total amount of the pressure applied to the fixation belt 211 is 270 N (27 kgf). The rotational speed of the fixation belt 211 is 150 mm/sec.

Next, referring to FIG. 7, the image forming apparatus 10 was placed in a measurement chamber 11, which was designed so that as the fresh supply of air enters into the chamber 11 through the air passage 12, the air in the chamber 11 is allowed to exit from the chamber 11 through the air passage 13, and also, that the vapor pressure of the volatile components in the chamber 11 changes in proportion to the amount of the volatile components emitted by the image forming apparatus 10. Then, the emission ratio of the volatile components in the air in the chamber 11 was tested as it came out of the chamber 11 through the air sampling passage 14. More concretely, the collected air was put through a film to catch the microscopic particles in the air. Then, the amount by which the filter increased in weight was measured. The filter was Elitolon (product of Toyobo Co., Ltd.).

The image forming apparatus 10 in this embodiment was tested under the following two conditions to compare the two conditions in the amount of volatile component emission:

(Condition 1): the image forming apparatus 10 was not equipped with the heat radiating portions 217 and 218;

(Condition 2): the image forming apparatus 10 was equipped with the heat radiating portions 217 and 218.

The image forming apparatus 10 equipped with the heat radiating portions 217 and 218 (Condition 1) was placed in the chamber 11, and was acclimated with the ambient temperature (24 degrees). Then, the image forming apparatus 10 was turned on. Then, the apparatus 10 was made to continuously output prints of a sample image, using sheets of ordinary paper which were 81 [g/m2] in basis weight, for ten minutes, while counting the captured microscopic particles, and measuring the surface temperature of the flange 216, every 2 minutes. More concretely, referring to FIG. 3, a thermocouple (type K: product of Anritsu Meter Co., Ltd.) was attached to the belt regulating (catching) portion 216*b* of the flange 216, in such a manner that it did not contact the fixation belt 211, to measure the surface temperature of the flange 216. Then, the image forming apparatus 10 was tested under Condition 2.

Referring to FIG. 8(*a*), under Condition 2 in which the image forming apparatus 10 was equipped with only the heat radiating portions 217 and 218, the amount of the volatile component emission was smaller than under Condition 1 in which the image forming apparatus 10 was not equipped with the heat radiating portions 217 and 218. Next, referring to FIG. 8(*b*), under Condition 2 in which the image forming apparatus 10 was equipped with the heat radiating portions 217 and 218, the surface temperature of the flange 216 remained lower than under Condition 1 in which the image forming apparatus 10 was not equipped with the heat radiating portions 217 and 218.

The comparison between the two conditions in the changes in the amount of the volatile component emission and the changes in the surface temperature of the flange 216 revealed the following: Under Condition 1 in which the image forming apparatus 10 was not equipped with the heat radiating portions 217 and 218, as the surface temperature of the flange 216 became higher than 80 degrees, the amount of the volatile component emission suddenly increased. In comparison, in the case of Condition 2 under which the image forming apparatus 10 did not suddenly increase in the amount of the volatile component emission, throughout the image forming operation which lasted for 10 minutes, the surface temperature of the flange 216 remained below 80 degrees. However, as the length of time that elapsed since the starting of the image forming operation reached 8 and 10 minutes, the surface temperature of the flange 216 increased close to 80 degrees, and the image forming apparatus 10 was likely to be substantially greater in the amount of the volatile component emission than before the elapse of 8 and 10 minutes.

Thus, it is reasonable to think that the occurrence of the above-described phenomena is attributable to the fact that the boiling point of the volatile components (volatile oily components) in the lubricant coated on the inward surface of the fixation belt 211 is roughly 80 degrees. Thus, under Condition 2 in which the flange 216 was fitted with the heat radiating portions 217 and 218, as the volatile components having evaporated from the lubricant move outward of the internal space of the fixation belt 200 along the flange 216, they are cooled by the surface of the flange 216 and the surface of the cooling portion 218, whereby being liquefied (solidified). Consequently, the amount of the volatile-component emission of the image forming apparatus 10 is reduced.

Effects of Embodiment 1

In the case of the fixing device 200 in the first embodiment, the heat radiating portion 217 is cooled through the natural convection of the air in the adjacencies of the heat radiating portion 217, whereby the temperature of the heat radiating portion 217 and the temperature of the flange 216 are kept substantially lower than the boiling temperature (roughly 80 degrees) of the volatile components of the lubricant. Thus, even though the latent heat in the gasified volatile components of the lubricant is discharged from the gasified volatile components as the gasified volatile components are condensed by the cooling surface of the cooling portion 218, the cooling portion 218 hardly increases in temperature.

As the gasified volatile components from the lubricant, which is high in temperature and is stagnant in the inward space of the fixation belt 211, contacts the flange 216 which is kept low in temperature, they are quickly lowered in temperature below their boiling temperature. Thus, they liquefy and/or solidify. In other words, the gasified volatile components from the lubricant are liquefied or solidified before they reach the flange 216. Therefore, it is unlikely that the gasified volatile components from the lubricant in the internal space W of the fixation belt 211 will be discharged outward of the space W. That is, the fixing device 200 remains in the state in which the gasified volatile components from the lubricant are hardly present in the casing of the fixing device 200.

That is, the fixing device 200 in the first embodiment can solidify the gasified volatile components from the lubricant, before the gasified volatile components leak out of the internal space W of the fixation belt 211. Therefore, it can prevent the problem that the gasified volatile components from the lubricant leak from the fixing device 200. In other words, it is superior in structure to any of developing devices in accordance with the prior art.

The fixing device 200 in this embodiment is provided with cooling fins which are attached to its heat radiating portion 217. Therefore, the cooling portion 218 and the flange 216 of the fixing device 200 remain high in their performance to condense the gasified volatile components from the lubricant. Thus, the fixing device 200 in this embodiment can prevent the above-described problem even in a case where the lubricant with which its fixation belt 211 is coated contains a substantial amount of volatile components. That is, even if the volatile components in the lubricant are gasified by high temperature, the gasified volatile components are not discharged from the image forming apparatus 10 into the ambient air. In other words, this embodiment can reduce the image forming apparatus 10 in the amount of several microscopic particles and ultramicroscopic particles which are no more than 100 nm in size, which the image forming apparatus 10 will discharge into the ambient air during image formation.

The efficiency with which the fixing device 200 in the first embodiment can capture the gasified oily components from the lubricant is satisfactory, and therefore, does not require a device dedicated to the capturing of the gasified oily components. Thus, it does not suffer from the problem that the image forming apparatus 10 has to be increased in size and/cost to accommodate a fixing device to accommodate a device dedicated to the capturing of the gasified oily components from the lubricant. Further, even if the fixation belt 211 is used at a high temperature level, and therefore, the volatile oily components in the lubricant such as grease are gasified, and also, the amount by which the volatile oily components are gasified due to the high temperature of the heater 212, it does not occur that the volatile oily components soil the interior of the casing of the image forming apparatus 10.

Figure 9:
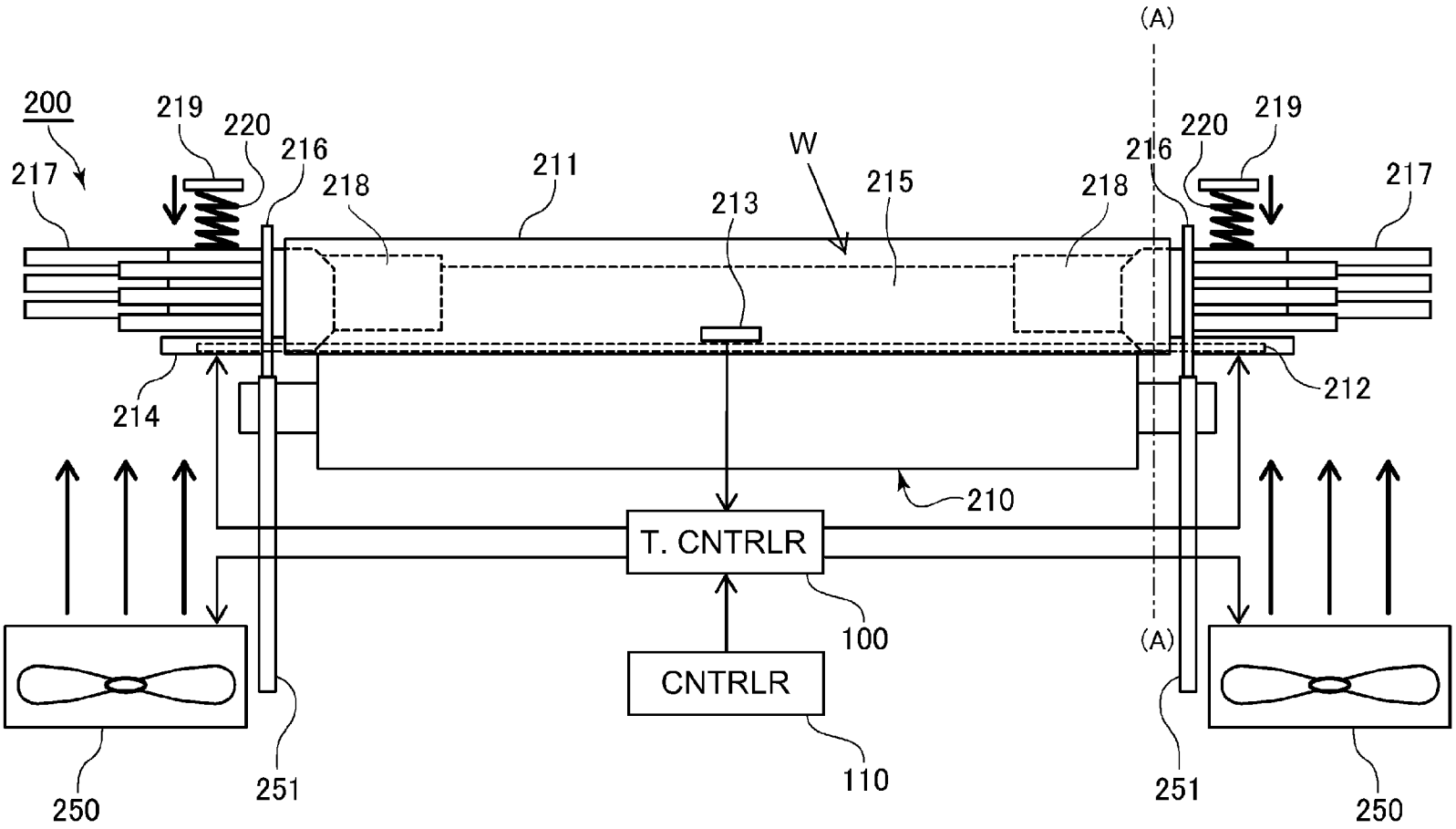
FIG. 9 is a schematic sectional view of the fixing device in the second embodiment of the present invention, at a plane perpendicular to the lengthwise direction of the fixing device. It is for illustrating the structure of the portion of the fixing device, which is for recovering the gasified volatile components of the grease applied to the inward surface of the fixation belt.
Figure 10:
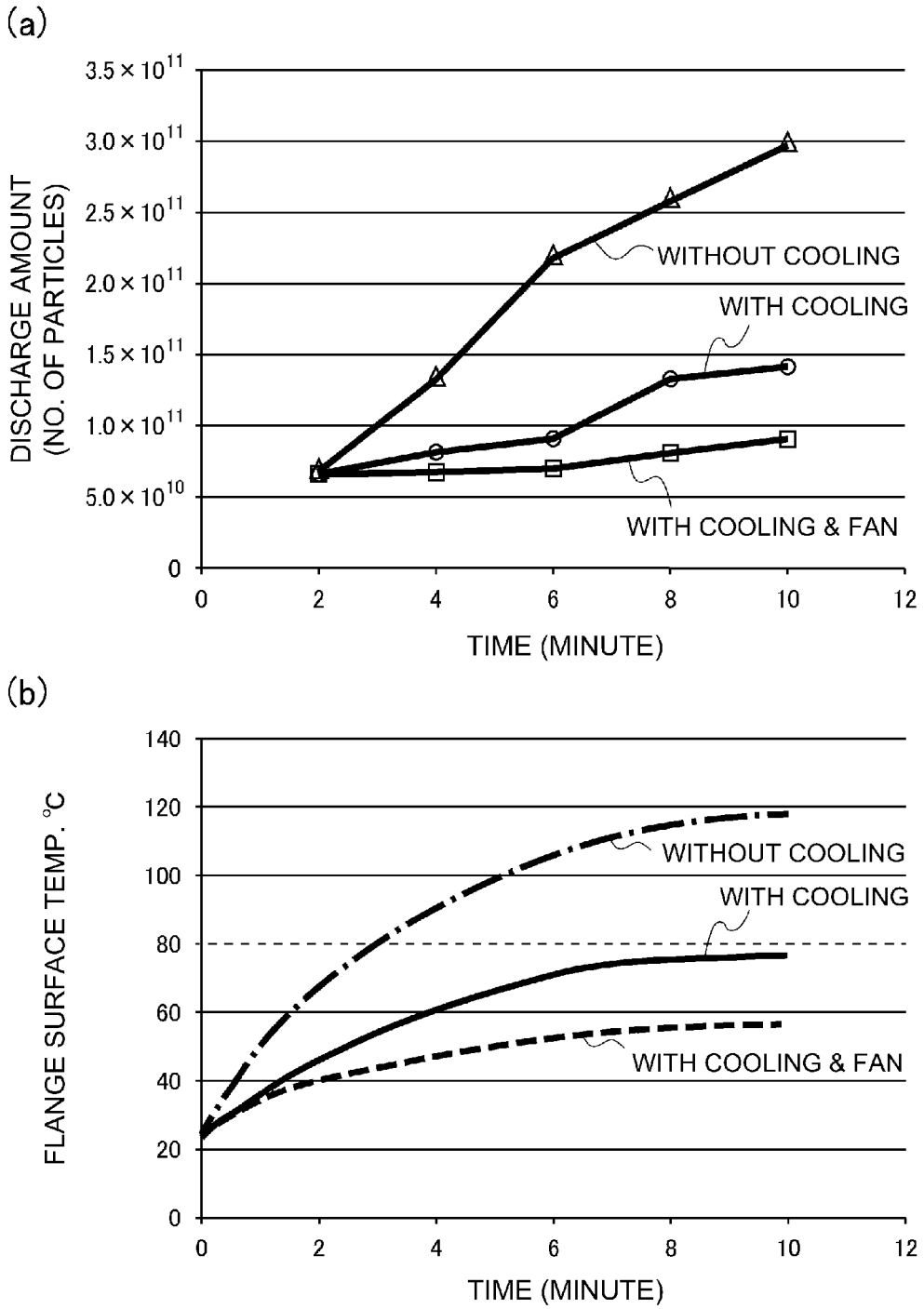
FIG. 10 is a combination of graphs for illustrating the effectiveness of the second embodiment in reducing a fixing device in the amount by which the gasified volatile components of the grease applied to the fixation belt are emitted from the image forming apparatus.

FIG. 9 is a schematic sectional drawing of the fixing device in the second embodiment of the present invention. More specifically, it is for illustrating the structure of the volatile component recovery portion of the fixing device. FIG. 10 is a combination of graphs, which is for illustrating the effects of this embodiment upon the reduction of the amount by which the volatile components in the lubricant are discharged from the image forming apparatus (fixing device). The fixing device 200 in this embodiment is the same in structure as the one in the first embodiment, except that the fixing device in this embodiment is provided with a pair of cooling fans for forcefully air-cooling the cooling members of the fixing device. Therefore, the structural components of the fixing device, shown in FIG. 9, which are the same in structure as the counterparts in the first embodiment are given the same reference numerals and characters as those given to the counterparts in FIG. 3, and are not described here.

Referring to FIG. 9, the cooling fan 250 blows air at the heat-radiating surface of the heat radiating portion 217. The air direction regulating member 251, which is an example of a blocking member, blocks the air from the cooling fan 250, in order to prevent the air-flow from the cooling fan 250 from reaching the fixation belt 211. The fixing device 200 in this embodiment is provided with the pair of air-flow regulating plates 251 in addition to the aforementioned cooling components, in order to forcefully air-cool the heat radiating portion 217, on the outward side of the flange 216. Therefore, the fixing device 200 in this embodiment is higher in the efficiency with which it can capture the gasified volatile components from the lubricant, with the use of the cooling portion 218 and flange 216, than the fixing device 200 in the first embodiment.

The cooling fan 250 is placed in a position in which it directly faces the flange 216 and the heat radiating portion 217. It blows air at the surface of the flange 216 to cool the flange 216.

More concretely, the cooling fan 250 blows low-temperature air at the fins of the heat radiating portion 217 to rid the fins of the heat radiating portion 217 of the high-temperature air, which remains stagnant in the adjacencies of the fins, in order to increase the heat-radiation efficiency of the heat radiating portion 217. As for the cooling fan 250, it cools the surface of the heat radiating portion 217.

If the air blown by the cooling fan 250 directly hits the surface of the fixation belt 211 and/or the peripheral surface of the pressure roller 210, it is possible that the surface temperature of the fixation belt 211 will locally decrease, which in turn will cause unsatisfactory fixation. Further, if the cooling fan 250 creates an unnecessary flow of air, in the casing of the fixing device 200, it is possible that the fixation belt 211 will be robbed of its heat, which in turn will increase the amount of electrical power necessary to maintain the temperature of the fixation belt 211 at the target level.

In this embodiment, therefore, the internal space of the fixing device 200 is partitioned with the use of the pair of air-flow direction regulating members 251 (partitioning member) so that the air blown by the cooling fan 250 will not have a direct effect upon the fixation belt placement space, which is on the inward side of the air-flow direction regulating member 251. That is, the air-flow direction regulating plate 251 regulates in direction, the air-flow generated by the cooling fan 250 in order to ensure that the flange 216 and the heat radiating portion 217 are satisfactorily cooled by the air-flow generated by the cooling fan 250, while preventing the fixation belt 211 and the pressure roller 210 from being cooled by the air-flow generated by the cooling fan 250.

Referring to FIG. 3, the heater temperature detected by the heater temperature sensor (thermistor) 213 is inputted into the control circuit 100, which determines whether the cooling fan 250 is to be turned on or off. In this embodiment, the cooling fan 250 is kept turned on as long as the heater 213 is being supplied with electric power, for the following reason. This control makes the flange 216 and the heat radiating portion 217 highest in cooling/heat-radiating efficiency, and therefore, makes it easier to confirm the effects of the provision of the fixing device with the pair of cooling fans 250, upon the capturing of the gasified volatile oily components of the lubricant (grease) by the fixing device. From the standpoint of reducing energy consumption, the cooling fan 250 may be changed in control. However, the cooling fan controls, which are different from the one in this embodiment will not be described here.

Evaluation of Embodiment 2

The image forming apparatus equipped with the fixing device in this embodiment was tested under the following conditions to compare the conditions in terms of the amount by which gasified volatile components from the lubricant was emitted by the image forming apparatus 10. The tests carried out to confirm the effects of this embodiment were the same as those used to confirm the effects of the first embodiment:

Condition 1: the fixing device 200 was not equipped with the heat radiating portions 217 and 218;

Condition 2: the fixing device 200 was equipped with the heat radiating portions 217 and 218;

Condition 3: fixing device 200 was equipped with the heat radiating portions 217 and 218, and the cooling fans 250, by which the heat radiating portions 217 and 218 were cooled.

Referring to FIG. 10(*a*), under Condition 3 in which the fixing device 200 was equipped with the cooling fan 250 in addition to the heat radiating portions 217 and 218, the fixing device 200 in this embodiment was higher in the efficiency with which the gasified volatile components from the lubricant were captured, being therefore smaller in the amount by which gasified components of the lubricant are emitted from the image forming apparatus 10, than under Condition 2 in which the fixing device 200 was equipped with only the heat radiating portions 217 and 218. Referring to FIG. 10(*b*), under Condition 3 in which the fixing device 200 was equipped with the cooling fan 250 in addition to the heat radiating portions 217 and 218, it was possible to keep the surface temperature of the flange 216 lower than under Condition 2 in which the fixing device 200 was provided with only the heat radiating portions 217 and 218. In other words, the second embodiment was superior to the first embodiment, in terms of the performance to capture the gasified volatile components from the lubricant (grease).

As long as the fixing device 200 is in normal use, even the first embodiment, in which the fixing device 200 does not have the cooling fan 250, can keep the surface temperature of the flange 216 and the surface temperature of the cooling portion 218 below 80 degrees, which is the boiling point of the volatile oily components of the lubricant, and therefore, can be expected to highly effectively capture the gasified volatile oily components from the lubricant.

However, if the fixing device 200 is substantially increased in speed and/or heating temperature, and/or is used under a severe condition, for example, in an ambience which is extremely high in temperature, it is possible that the first embodiment in which the fixing device 200 is not equipped with the cooling fan 250 will be unlikely to highly effectively capture the gasified volatile oily components from the lubricant. Therefore, the second embodiment in which the fixing device 200 is equipped with the cooling fan 250 is highly effective to capture the gasified volatile oily components from the lubricant.

Embodiment 3

Figure 11:
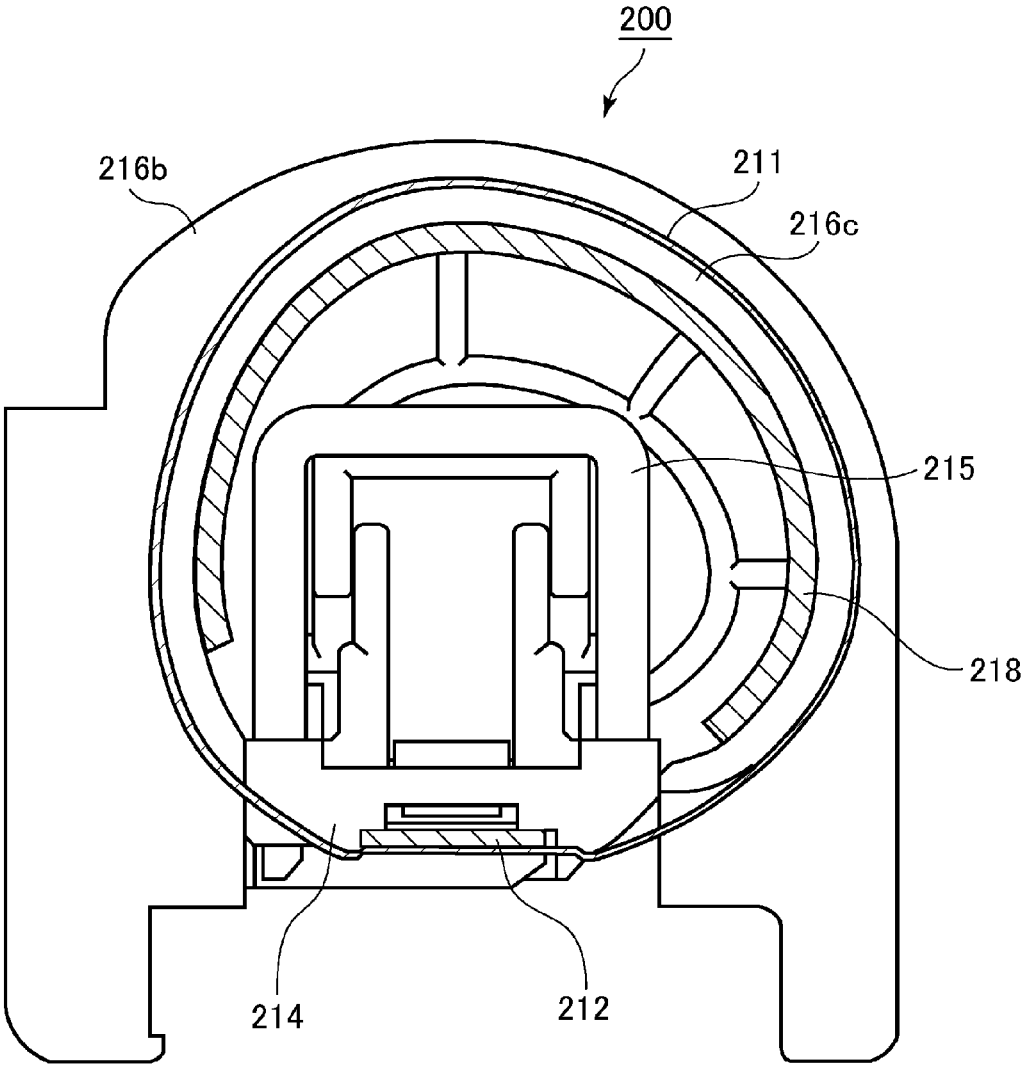
FIG. 11 is a schematic cross-sectional view of one of the lengthwise portions of the fixation belt portion of the fixing device in the third embodiment of the present invention.

FIG. 11 is a schematic cross-sectional view of one of the end portions of the fixation film 211, and its adjacencies, of the fixing device 200 in the third embodiment of the present invention. It is for illustrating the structure of the end portion. FIG. 11 corresponds to the plane (A)-(A) in FIG. 3.

Referring to FIG. 11, the cooling portion 218 is an integral part of the flange 216. The heat radiating portion 217 in this embodiment cools both the flange 216 and the cooling portion 218 to keep the temperature of the flange 216 and the temperature of the cooling portion 218 below the boiling temperature of the volatile components of the lubricant, as shown in FIG. 3.

<Miscellanies>

In the foregoing, a few of preferred embodiments of the present invention were described. However, these embodiments were not intended to limit the present invention in scope in terms of fixing device structure. That is, it is needless to say that the present invention is also applicable to known image heating apparatuses which are different in structure from those in the preceding embodiments, within the scope of the present invention. That is, the application of the present invention is not limited to a fixing device, the fixation belt of which is placed in contact with the toner-bearing surface of a sheet of recording medium. For example, the present invention is also applicable to a fixing device, the fixation belt of which is placed in contact with the opposite surface of a sheet of recording medium from the image-bearing surface of the sheet. Further, the present invention is applicable to a fixing device structured so that its rotational member, which forms a nip by being placed in contact with its fixation belt, is also a belt instead of a roller. Further, the application of the present invention is not limited to fixing devices having a combination of a fixation belt and a pressure roller. For example, the present invention is also applicable to fixing devices having a combination of a fixation belt and a pressure belt, or a combination of a fixation roller and a pressure belt.

The measurements, materials, and shapes of the structural components of the image forming apparatuses and fixing devices in the first and second embodiments described above, and the positional relationship among the structural components, are not intended to limit the present invention in scope in terms of these properties. The numerical values mentioned in the description of these embodiments happened to be optimal in the experiments in which these image forming apparatuses and fixing devices were tested. In other words, the values for these properties should no be simply set according to the structure or the like properties of a fixing device.

In the foregoing embodiments, the primary volatile components in the lubricant (grease) were oils, the boiling points of which were roughly 80 degrees. However, lubricant selection in terms of type and boiling point is optional; it may be made according to the embodiment of the present invention and the materials used for the embodiment.

Also in the foregoing embodiments, the heat radiating portions 217 and 218 were not integral parts of the flange 216. Further, they were used in connection to each other. However, the heat radiating portions 217 and 218 may be formed of the same material as the flange 216, and may be formed as integral parts of the flange 216, in order to improve the thermal conduction between the flange 216 and the heat radiating portions 217 and 218 to improve the heat-radiating portion in performance. In this case, the flange 216 may be changed in shape so that the belt supporting slippery surface 216*c* would be longer, and the supporting stay end holding portion 216*a* would be provided with fins.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 113650/2013 filed May 30, 2013, which is hereby incorporated by reference.

What is claimed is:

1. An image heating apparatus comprising:

an endless belt configured to heat a toner image on a sheet in a nip, wherein an inner surface of said endless belt is coated with a lubricant;

a driving rotatable member cooperative with said endless belt to form said nip and configured to feed said endless belt;

an urging member provided inside said endless belt and configured to urge said endless belt toward said driving rotatable member;

a first regulating portion configured and positioned to regulate the position of said endless belt with respect to a longitudinal direction thereof, said first regulating portion being configured to be abutted by one longitudinal end edge of said endless belt;

a first heat sink provided on said first regulating portion and configured to cool said first regulating portion;

a second regulating portion configured and positioned to regulate the position of said endless belt with respect to the longitudinal direction thereof, said second regulating portion being configured to be abutted by the other longitudinal end edge of said endless belt; and a second heat sink provided on said second regulating portion and configured to cool said second regulating portion.

2. An apparatus according to claim 1, further comprising a cooling mechanism configured to cool a heat radiating portion of said first heat sink and a heat radiating portion of said second heat sink with air.

3. An apparatus according to claim 2, wherein said cooling mechanism includes a fan, and an isolation member configured and positioned to isolate said endless belt from air flow produced by said fan.

4. An apparatus according to claim 1, further comprising a back-up member configured and positioned to back-up said urging member, wherein said first heat sink and said second heat sink are mounted to said back-up member through a heat insulating member.

5. An apparatus according to claim 1, wherein the lubricant is grease.

6. An apparatus according to claim 1, wherein said urging member is provided with a heat generating element configured to generate heat by electric power supplied thereto.

7. An image heating apparatus comprising:

an endless belt configured to heat a toner image on a sheet in a nip, wherein an inner surface of said endless belt is coated with a lubricant;

a driving rotatable member cooperative with said endless belt to form said nip and configured to feed said endless belt;

an urging member provided inside said endless belt and configured to urge said endless belt toward said driving rotatable member;

a first hollow regulating portion configured and positioned to regulate the position of said endless belt with respect to a longitudinal direction thereof, said first hollow regulating portion being configured to be abutted by one longitudinal end edge of said endless belt;

a first heat sink extending from an inside space of said endless belt to an outside through a hollow portion of said first hollow regulating portion configured and positioned to cool said first hollow regulating portion;

a second hollow regulating portion configured and positioned to regulate the position of said endless belt with respect to a longitudinal direction thereof, said second hollow regulating portion being configured to be abutted by the other longitudinal end edge of said endless belt; and a second heat sink extending from the inside space of said endless belt to an outside through a hollow portion of said second hollow regulating portion configured and positioned to cool said second hollow regulating portion.

8. An apparatus according to claim 7, further comprising a cooling mechanism configured to cool a heat radiating portion of said first heat sink and a heat radiating portion of said second heat sink with air.

9. An apparatus according to claim 8, wherein said cooling mechanism includes a fan, and an isolation member configured and positioned to isolate said endless belt from air flow produced by said fan.

10. An apparatus according to claim 7, further comprising a back-up member configured and positioned to back-up said urging member, wherein said first heat sink and said second heat sink are mounted to said back-up member through a heat insulating member.

11. An apparatus according to claim 7, wherein the lubricant is grease.

12. An apparatus according to claim 7, wherein said urging member is provided with a heat generating element configured to generate heat by electric power supplied thereto.

* * * * *